United States Patent [19]

Christenson et al.

[11] 4,159,059

[45] Jun. 26, 1979

[54] TRUSS BOOM FOR MATERIAL HANDLING TRUCK

[75] Inventors: John C. Christenson; Clark T. Zunker, both of Wausau, Wis.

[73] Assignee: Loed Corporation, Wausau, Wis.

[21] Appl. No.: 889,226

[22] Filed: Mar. 23, 1978

Related U.S. Application Data

[63] Continuation of Ser. No. 720,374, Sep. 3, 1976, abandoned.

[51] Int. Cl.[2] ..... B66F 3/36

[52] U.S. Cl. ..... 414/724; 212/144; 414/722; 414/607

[58] Field of Search ..... 214/141, 145 R, 145 A, 214/620, 621; 212/144

[56] References Cited

U.S. PATENT DOCUMENTS

| | | | |
|---|---|---|---|
| 2,183,867 | 12/1939 | Johansen | 212/144 X |
| 2,760,661 | 8/1956 | Wight et al. | 214/620 |
| 2,831,592 | 4/1958 | Syracuse | 214/620 X |
| 3,007,592 | 11/1961 | Adams | 214/620 |
| 3,092,259 | 6/1963 | Swanson | 214/145 R X |
| 3,294,262 | 12/1966 | Person | 214/620 X |
| 3,410,432 | 11/1968 | Foss et al. | 214/620 |
| 3,773,200 | 11/1973 | Morris | 214/620 |
| 3,836,025 | 9/1974 | Olson et al. | 214/141 X |

*Primary Examiner*—L. J. Paperner

*Attorney, Agent, or Firm*—Allegretti, Newitt, Witcoff & McAndrews

[57] ABSTRACT

A truss boom attachment for mounting on a fork assembly operatively mounted on a material handling truck. The fork assembly includes a rigid upright frame which receives a pair of load carrying forks. The truss boom attachment comprises a generally longitudinally elongated rigid truss frame which has an upright rigid rear end and a front end. Detachable hooks are defined on the rear end of the truss frame for detachably securing the truss boom on the rigid fork assembly of the material handling truck. A cable assembly, including a load carrying drop block, is operatively carried on the material handling truck and the cable is guidably carried on the truss boom with the drop block passing downwardly from the front end of the truss boom so the material or load being handled by the truck can be readily moved from one location to another.

9 Claims, 8 Drawing Figures

TRUSS BOOM FOR MATERIAL HANDLING TRUCK

This is a continuation of application Ser. No. 720,374, filed Sept. 3, 1976 now abandoned.

BACKGROUND OF THE INVENTION—FIELD OF THE INVENTION AND DESCRIPTION OF THE PRIOR ART

This invention relates to an attachment for mounting on the end of material handling equipment for extending the horizontal reach of the equipment, and it particularly relates to a generally horizontally elongated truss frame which is operatively interconnected to a fork assembly of a material handling truck wherein the truss boom carries a cable assembly thereon to significantly extend the horizontal reach of the equipment.

In the design and construction of any material handling equipment, it is generally considered to be particularly advantageous to provide equipment which is versatile in its basic design and which is capable of having various types of attachments mounted thereon to even further add to the versatility of the equipment. In Olson et al U.S. Pat. No. 3,836,025, material handling equipment is disclosed which is highly versatile in its basic design. The fork lift assembly, which is operatively mounted at the end of a telescoping boom, is pivotal through an upright plane on the material handling truck. Because of the mobility of the truck, the extendibility of the boom, the upright pivoting movement of the boom, and desirably, the pivoting of the fork assembly about an upright axis, the equipment is particularly versatile in use and operation. The disclosed equipment also desirably includes a cable attachment which includes a drop block arrangement. Particularly when using the drop block arrangement of Olson et al, the horizontal reach of the equipment is relatively limited. Although the fork assembly could be permanently elongated in a longitudinal direction, it is not considered practical to have such a permanent attachment which extends significantly beyond the outer end of the boom in a horizontal direction as such an arrangement would undoubtedly ultimately reduce the versatility and possibly even reduce the load carrying capacity of the fork assembly.

It is therefore considered highly advantageous to provide a suitable attachment for equipment of the type shown in the Olson et al patent which would extend the horizontal reach of the equipment, when utilizing the drop block attachment, and yet provide an attachment which may be readily attached and detached from the fork assembly normally mounted at the outer end of the telescoping boom.

SUMMARY OF THE INVENTION

It is therefore an important object of this invention to provide a unique horizontally elongated truss boom which may be detachably interconnected to a fork lift section of a material handling truck.

It is another important object of this invention to provide a highly unique truss boom attachment for mounting at the end of a telescoping boom which includes an arrangement for securing the truss boom to the fork lift assembly, wherein the operator may attach and detach the truss boom to the telescoping boom without leaving the controls of the equipment.

It is a further object of this invention to provide an improved truss boom which is operatively mounted at the end of a telescoping boom on a fork lift assembly, wherein a cable is operatively carried on the telescoping boom and means are provided on the truss boom for guiding the cable and positioning a drop block, carried at the outer end of the cable, at the front end of the truss boom.

It is still another important object of this invention to provide a unique truss boom which may be detachably and attachably secured to a fork lift assembly mounted at the end of a telescoping boom arrangement which includes a cable assembly operatively carried on the boom and guidably carried on the truss boom, wherein the truss boom and/or its attachment arrangement are characterized by their simplicity and economy of construction and manufacture and versatility and simplicity in operation.

Further purposes and objects of this invention will appear as the specification proceeds.

The foregoing objects are accomplished by providing, for use with material handling equipment, particularly of the type which includes a fork lift assembly having a rigid upright frame which is operatively mounted on a material handling truck, a truss boom attachment comprising a horizontally elongated rigid truss frame which has an upright rigid, rear end and a front end, an attachment assembly being defined on the rear end of the truss boom for detachable securement of the truss frame to the fork assembly, and a cable arrangement being operatively mounted on the material handling equipment, the cable being carried on guides provided on the truss boom and having a drop block which passes over the front end of the boom and is operatively movable in a vertical direction for securement to a load for moving such a load from one location to another.

BRIEF DESCRIPTION OF THE DRAWINGS

Referring to the drawings, there is shown one particular embodiment of the present invention wherein.

DETAILED DESCRIPTION OF THE PREFERRED EMBODIMENT

Figure 1:
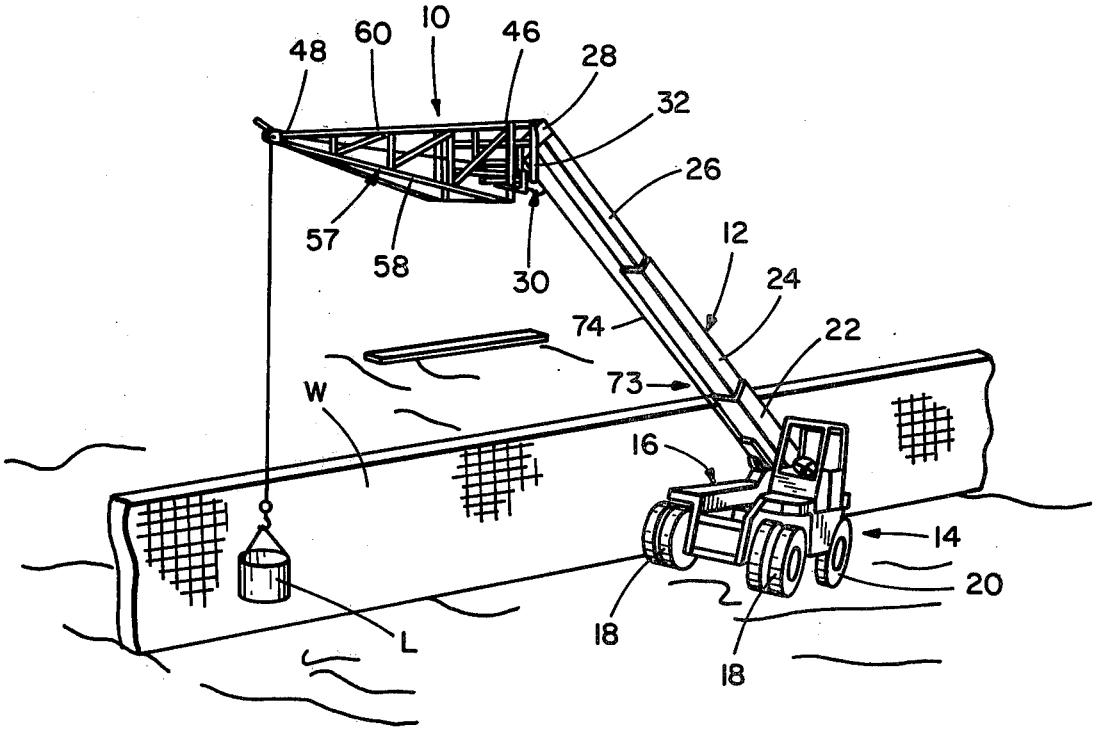
FIG. 1 is a pictorial view of a material handling truck with a telescoping boom having a fork lift assembly at the outer end thereof and with our unique horizontally elongated truss boom detachably mounted on the fork lift assembly.
Figure 2:
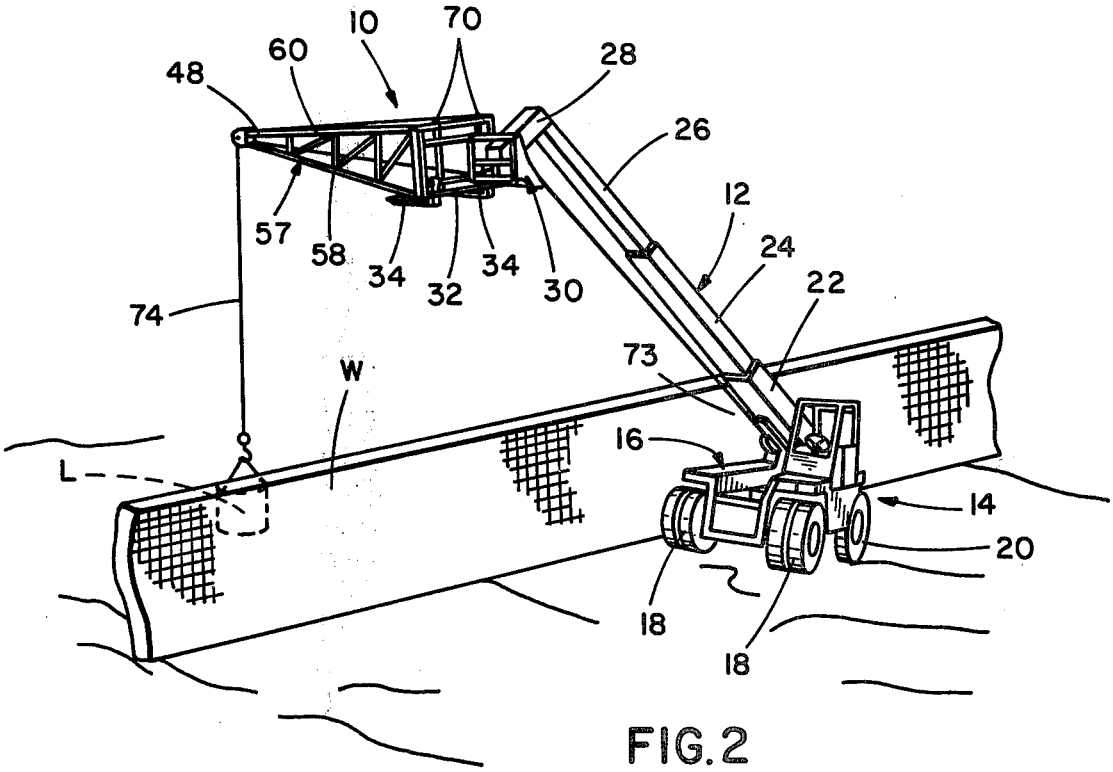
FIG. 2 is a view, similar to FIG. 1, except the equipment is shown with a load having been moved over a vertical abutment or wall from the position shown in FIG. 1.

Referring to the drawings, particularly FIGS. 1 and 2, our truss boom assembly, generally 10, is shown mounted on the end of a telescoping boom, generally 12, which is operatively carried on a material handling truck, generally 14. Although the truss boom assembly 10 is shown mounted on the telescoping boom 12 and the truck 14, it is to be understood that the truss boom is not to be limited to use with the specific construction shown and that the truss boom 10 may be used in order to extend the horizontal reach of various types of material handling mechanisms, particularly of the type which includes a material handling fork assembly. The truck 14 and telescoping boom 12 are particularly advantageously used in connection with our unique truss boom 10 because of the significant versatility involved in the ability of the truck 14 to handle loads and move the same from one position to another. The telescoping boom 12 and truck 14 are advantageously constructed in accordance with many of the details described in the Olson et al U.S. Pat. No. 3,836,025. Thus, although the preferred use of the truss boom 10 is in connection with the equipment of the type shown in FIGS. 1 and 2 and/or in the said Olson et al U.S. Pat. No. 3,836,025, it is to be understood that the use of the truss boom 10 is not limited to such equipment.

The truck 14 and boom 12 will be only generally described herein, as many of the details thereof may be found described in the aforementioned Olson et al U.S. Pat. No. 3,836,025.

The truck 14 includes a frame 16. A pair of front wheels 18 and a pair of rear wheels 20 are operatively mounted on the truck frame 16. The telescoping boom 12 is desirably pivotal in a generally upright longitudinal plane, relative to the frame 16, about a horizontal transverse pivot axis mounting (not shown) on the boom 12 on the frame 16. The telescoping boom 12 generally includes a fixed boom section 22, an intermediate moving boom section 24 slidably carried by the fixed section 22, and an outer movable boom section 26 which is slidably carried by the intermediate boom section 24. A suitable lift cylinder (not shown) is operatively mounted between the frame 16 and the telescoping boom 12 to pivot the boom 12 through the upright plane relative to the frame 16. A suitable boom extension drive (not shown) is provided for extending and retracting the telescoping boom 12. Both the lift cylinder and the boom extension drive may be of the type shown in the said Olson et al U.S. Pat. No. 3,836,025.

The outer end of the outer section 26 of the telescoping boom 12 desirably has a normally downwardly and forwardly extending arm 28 secured thereon. The arm 28 has a fork assembly, generally 30, operatively carried thereon. Desirably a tilt cylinder (not shown) is operatively interconnected between the fork assembly 30 and the arm 28 of the outer boom section 26. In a conventional manner, the tilt cylinder normally pivots the fork assembly 30 relative to the arm 28, about a transverse horizontal axis so that the fork assembly 30 is normally maintained in a substantially upright position so that the material being carried thereby does not slide off when the boom 12 is being pivoted in its upright pivot plane.

Figures 3, 4, 5:
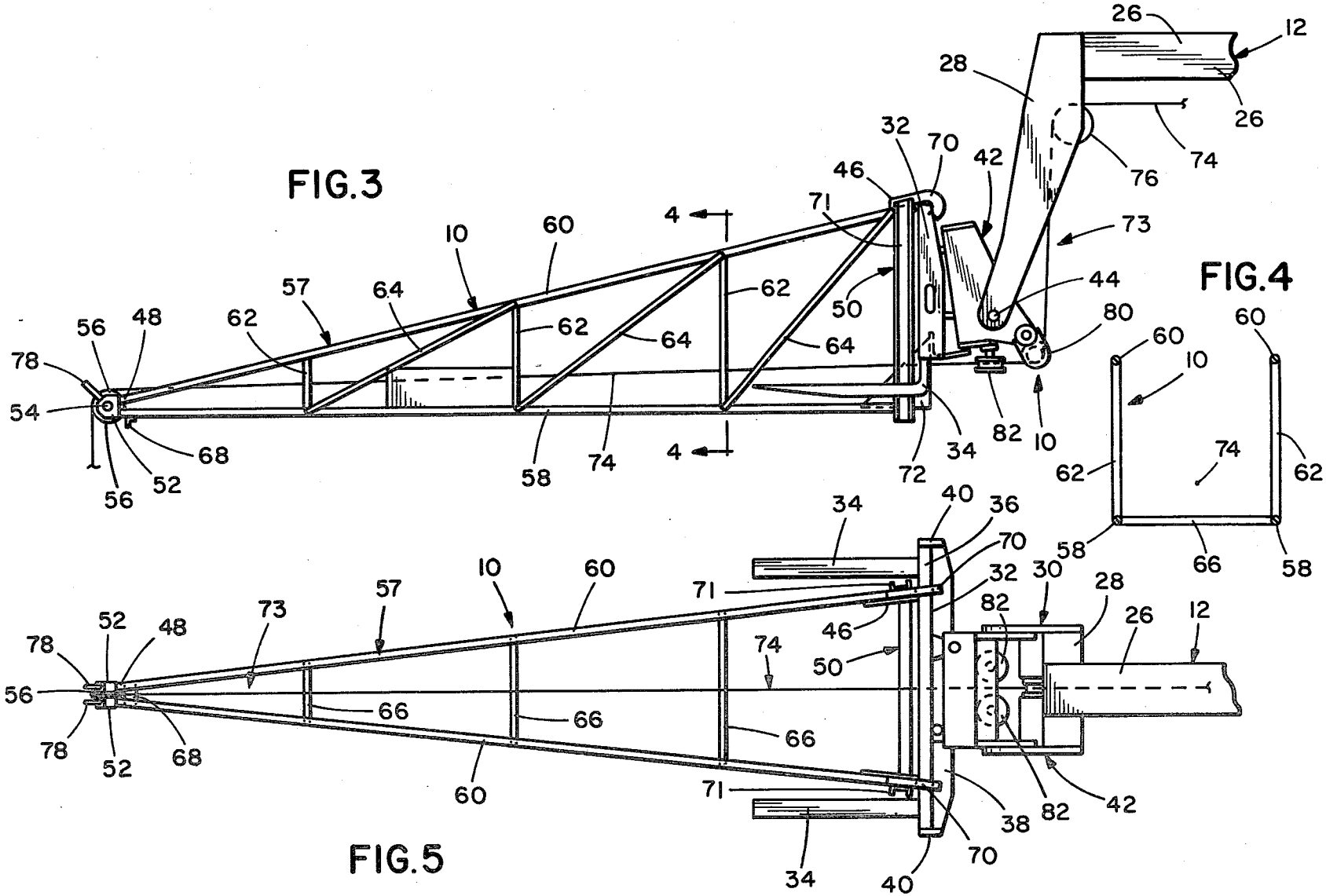
FIG. 3 is a detailed side elevational view illustrating the truss boom and the attachment arrangement thereon for connecting the truss boom to the fork assembly and illustrating the arrangement used to carry the cable on the boom of the material handling truck and on the truss boom.
FIG. 4 is a sectional view taken along the line 4—4 of FIG. 3 showing the cross-sectional shape of the boom.
FIG. 5 is a top plan view of the truss boom illustrated in FIG. 3.
Figures 6, 7, 8:
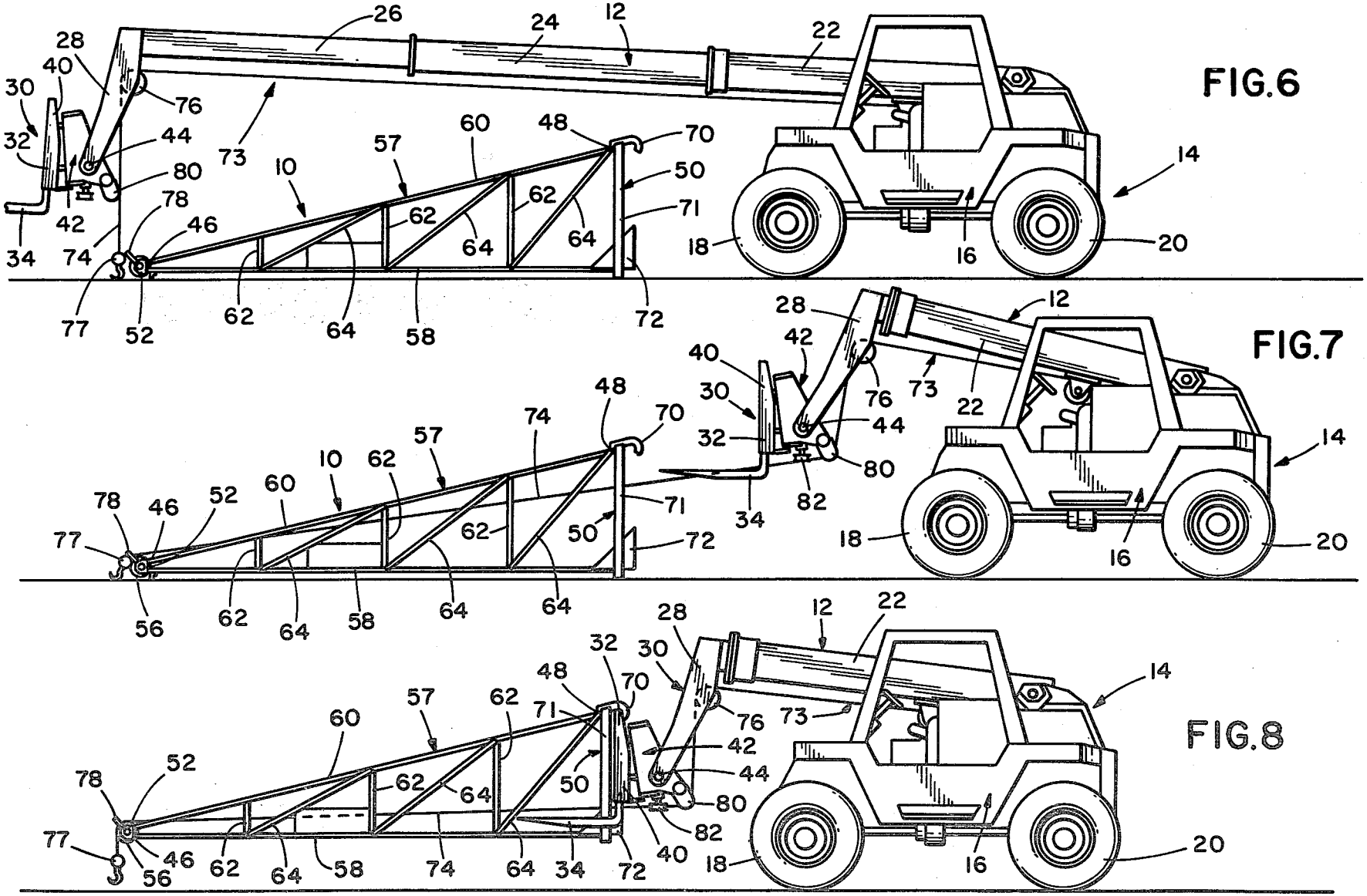
FIG. 6 is a side elevational view illustrating the first step of the manner in which an operator may readily attach the truss boom to the fork lift assembly located at the outer end of the telescoping boom.
FIG. 7 is a view, similar to FIG. 6, illustrating a subsequent step whereby the operator may readily attach the truss boom to the fork lift assembly mounted at the end of the telescoping boom.
FIG. 8 is a view, similar to FIGS. 6 and 7, illustrating the final step whereby the operator may conveniently secure the truss boom to the fork assembly at the outer end of the telescoping boom arrangement.

As best seen in FIGS. 3 and 5, the fork assembly 30 includes an upright rear frame, generally 32, which carries a pair of forwardly projecting, load carrying forks 34 which are used for engaging the load that is to be moved from one location to another by the equipment. The upright fork frame 32 includes a rigid upper cross member 36, a rigid lower cross member 38, and a pair of spaced upright rigid supports 40 which interconnect the opposite ends of the lower cross member 38 and upper cross member 36.

As seen in FIGS. 3 and 5, the outer end of the arm 28 of the boom 12 is pivotally interconnected to a fork tilt carriage 42 at a transverse horizontal pivot axis 44. A suitable hydraulic tilt cylinder (not shown) is operatively interconnected between the arm 28 and the tilt carriage 42, as mentioned above, so as to pivot the fork assembly 30 about the pivot axis 44 and thereby maintain the forks 34 in a substantially level position during the pivoting movement of the telescoping boom 12 on the truck 14. The tilt carriage 42, the upright frame 32, and the forks 34 are all considered a part of the fork assembly 30.

The truss boom 10 comprises a normally horizontally elongated rigid, welded structure. The boom 10 generally includes a rear end 46 and a front end 48. The rear end 46 of the boom is defined by a substantially U-shaped frame, generally 50. The front end of the truss boom 10 is dimensionally reduced relative to the rear end 46 of the truss boom 10.

The front end 48 of the truss boom 10 is defined by a pair of rigid upright side blocks 52 which are externally interconnected by a cross rod 54. The cross rod 54 pivotally or rotatably carries an idler pulley 56. Each side block 52 is interconnected to the rear frame 50 by a side frame, generally 57, which includes substantially horizontal elongated rigid lower rod 58 and an upwardly and rearwardly angled elongated upper rod 60. The lower rod 58 is rigidly secured to the side block 52, as by welding and is rigidly secured to the lower rear corner of the rear frame 50 of the truss boom 10. The upper rod 60 is rigidly secured, as by welding, to a side block 52 and is secured to the upper rear corner of the rear frame 50 of the truss boom 10. A plurality of upright supports 62 are secured to, as by welding, the lower rod 58 and upper rod 60. Angle braces 64 are rigidly secured, at one end, to the intersection of the lower end of one of the upright supports 62 with the lower rod 58 and to the upper end of an adjacent upright support member 62 at the interconnection with the upper rod 60. Block 52, a lower rod 58, an upper rod 60, upright supports 62, and angle supports define the side frame 57. The side frames are interconnected by a plurality of rigid cross support rods 66 which pass between the lower rods 58. The frame 50 interconnects the rear end of the two side frames 57. In order to provide for added rigidity at the front end 48 of the truss boom 10, an angle member 68 is rigidly secured, as by welding, to the underside to each of the rigid lower rods 58 at the front end thereof.

A pair of rigid downwardly extending hook members 70 are rigidly secured at the upper ends of spaced legs 71 of the rigid U-shaped rear frame 50 of the truss boom 10. The hook members 70 enable the truss boom 10 to be detachably and attachably secured to the upright frame 32 of the fork assembly 30 in a highly simple and effective manner, as will be hereinafter described in greater detail. The lower corners of the rear frame 50 include rigid upright gusset plates 72 which, as will be shown, are constructed and arranged to bear against the lower cross member 38 of the fork assembly 30. As will be tachably securing said truss frame on said rigid upright frame while continuing to support said truss frame attachment in a generally forwardly extending direction, said truss frame being constructed and arranged to normally be in a forward direction both in an attached position and in a detached position, and, when in said detached position, said cooperating securing means defining the sole means for interconnecting said truss frame to said telescoping boom and being immobile while said boom is manipulated for attaching said frame to said boom, a rigid member on said upright frame and hook means on said rear end of said truss frame, said hook means being detachably received by said rigid member, cable means, means for operatively mounting said cable means on said equipment, and means on said truss frame for guiding said cable means thereon for engaging and moving material located at said front end of said truss frame, both said means for operatively mounting said frame on said equipment and said means for operatively mounting said cable means on said equipment being entirely on said equipment and said cable means only being guided and supported on said truss frame.

2. The attachment of claim 1 wherein said truss frame is U-shaped in upright cross section and said cable means is positioned within said truss frame.

3. The attachment of claim 2 wherein means are provided on said front end and said rear end of said boom for guidably supporting said cable means on said truss boom attachment.

4. The attachment of claim 1 wherein said truss boom includes a pair of rigid side frames, supports interconnecting the bottom portions only of said side frames, a front end section interconnecting said side frames, and a U-shaped rear frame section interconnecting said side frames.

5. The attachment of claim 1 wherein said equipment comprises a fork lift assembly, and said upright frame is part of said fork assembly.

6. The attachment of claim 1 wherein said upright frame includes a lower cross member, and said rear end of said truss frame includes rigid means which bear against said lower cross member to maintain said truss frame in a normally forwardly extending position.

7. The attachment of claim 6 wherein said upright frame includes a lower cross member, and said rear end of said truss frame includes rigid means which bear against said lower cross member to maintain said truss frame in a normally forwardly extending position.

8. The attachment of claim 1 including means for laterally maintaining said truss boom on said upright frame.

9. The attachment of claim 8 wherein said upright frame comprises a fork assembly having a pair of forks, each of said forks being positioned on opposite sides of the outer sides of said rear end of said frame to define said lateral maintaining means.

* * * * *